US005854586A

United States Patent [19]

McMillan et al.

[11] Patent Number: 5,854,586

[45] Date of Patent: Dec. 29, 1998

[54] RARE EARTH DOPED ZINC OXIDE VARISTORS

[75] Inventors: April D. McMillan, Knoxville; Frank A. Modine; Robert J. Lauf, both of Oak Ridge, all of Tenn.; Mohammad A. Alim, Medina, Ohio; Gerald D. Mahan; Miroslaw Bartkowiak, both of Oak Ridge, Tenn.

[73] Assignee: Lockheed Martin Energy Research Corporation, Oak Ridge, Tenn.

[21] Appl. No.: 932,948

[22] Filed: Sep. 17, 1997

[51] Int. Cl.[6] ..... H01C 7/10

[52] U.S. Cl. ..... 338/21; 252/518

[58] Field of Search ..... 338/21, 20; 252/518, 252/519

[56] References Cited

U.S. PATENT DOCUMENTS

| | | | |
|---|---|---|---|
| 3,838,378 | 9/1974 | Matsuoka et al. | 338/20 |
| 3,936,396 | 2/1976 | Masuyama et al. | 252/518 |
| 4,160,748 | 7/1979 | Yodogawa et al. | 252/518 |
| 4,320,379 | 3/1982 | Yodogawa | 338/21 |
| 4,386,022 | 5/1983 | Nagasawa et al. | 252/521 |
| 5,004,573 | 4/1991 | Oh et al. | 264/61 |
| 5,369,390 | 11/1994 | Lin et al. | 338/21 |

*Primary Examiner*—Mark H. Paschall
*Assistant Examiner*—Jeffrey Pwu
*Attorney, Agent, or Firm*—Joseph A. Marasco

[57] ABSTRACT

A varistor includes a Bi-free, essentially homogeneous sintered body of a ceramic composition including, expressed as nominal weight %, 0.2–4.0% oxide of at least one rare earth element, 0.5–4.0% $Co_3O_4$, 0.05–0.4% $K_2O$, 0.05–0.2% $Cr_2O_3$, 0–0.2% CaO, 0.00005–0.01% $Al_2O_3$, 0–2% MnO, 0–0.05% MgO, 0–0.5% $TiO_3$, 0–0.2% $SnO_2$, 0–0.02% $B_2O_3$, balance ZnO.

7 Claims, 4 Drawing Sheets

RARE EARTH DOPED ZINC OXIDE VARISTORS

The United States Government has rights in this invention pursuant to contract no. DE-AC05-960R22464 between the United States Department of Energy and Lockheed Martin Energy Research Corporation.

FIELD OF THE INVENTION

The present invention relates to rare earth doped ZnO varistors and methods of making the same, and more particularly to rare earth doped ZnO varistors made by methods involving liquid-vehicle mixing and spray-drying.

BACKGROUND OF THE INVENTION

Varistors, also known as nonlinear electrical resistors, are generally utilized as electrical surge arrestors. Surge arresters based upon zinc oxide are used extensively to protect electrical equipment and to increase the reliability of electrical power distribution.

The capacity of conventionally made arrester materials to absorb power is limited by failures associated with nonuniformity of density and/or grain size and a propensity for thermal runaway that stems from Joule heating and the negative temperature coefficient of the resistance of the material.

Varistors are vulnerable to failure as a result of current localization. Localized currents cause local heating, which leads to melting and puncture, or to nonuniform thermal expansion and thermal stresses, which lead to fracture of the varistor material.

The voltage breakdown characteristic (electric field/current density) is indicative of the uniformity of the grain boundaries within a varistor. Optimally, the resistance characteristic of a bulk material varistor is "sharp"; the material exhibits minimum leakage current up to breakdown voltage, and breaks sharply as the voltage applied thereto reaches breakdown voltage. Thence, the resistance of the bulk material varistor rapidly approaches that of a single grain of the same material. Further information relating to electrical characteristics of varistors can be found in M. Bartkowiak, et al., "Voroni Network Model of ZnO Varistors with Different Types of Grain Boundaries", *Journal of Applied Physics,* Vol. 80, No. 11, Dec. 1, 1996.

Greater uniformity and voltage breakdown characteristics of varistor materials has been accomplished with some varistor compositions via sol-gel processing instead of conventional calcining, but such processing is relatively expensive.

There is therefore a need for a varistor material having improved voltage breakdown characteristics, are capable of absorbing more electrical energy without failing, and provide better electrical protection at a lower manufacturing cost. New compositions and processing methods which improved distribution of constituents would decrease the failure rate of varistors considerably.

OBJECTS OF THE INVENTION

Accordingly, it is an object of the present invention to provide a varistor characterized by improved nonlinearity, very high breakdown field, and a sharp breakdown characteristic.

It is also an object of the present invention to provide a varistor characterized by improved uniformity of constituents thereof.

It is a further object of the present invention to provide a method of making a varistor characterized by improved uniformity of constituents thereof.

It is another object of the present invention to provide a varistor characterized by minimized vulnerability to failures associated with nonuniformity of density, grain size and/or current localization.

It is yet another object of the present invention to provide a method of making a varistor characterized by minimized vulnerability to failures associated with nonuniformity of density, grain size/and or current localization.

Further and other objects of the present invention will become apparent from the description contained herein.

SUMMARY OF THE INVENTION

In accordance with one aspect of the present invention, the foregoing and other objects are achieved by a varistor which includes a Bi-free, essentially homogeneous sintered body of a ceramic composition including, expressed as nominal weight %, 0.2–4.0% oxide of at least one rare earth element, 0.5–4.0% $Co_3O_4$, 0.05–0.4% $K_2O$, 0.05–0.2% $Cr_2O_3$, 0–0.2% CaO, 0.00005–0.01% $Al_2O_3$, 0–2% MnO, 0–0.05% MgO, 0–0.5% $TiO_3$, 0–0.2% $SnO_2$, 0–0.02% $B_2O_3$, balance ZnO.

In accordance with another aspect of the present invention, a method of making a varistor includes the steps of:

a. preparing an essentially homogeneous slurry comprising a liquid spray-drying vehicle and a Bi-free mixture of appropriate solid constituents including: 0.2–4.0% $Pr_6O_{11}$, 0–4.0% $Co_3O_4$, 0–0.4% $K_2CO_3$, 0–0.2% $Cr_2O_3$, 0–0.2% $CaCO_3$, 0.0004–0.075% $Al(NO_3)_3.9H_2O$, 0–15% $MnCO_3$, 0–0.1% $MgCO_3$, 0–0.5% $TiO_2$, 0–0.2% $SnO_2$, 0–0.02% $H_3BO_3$, balance ZnO;

b. spray-drying the slurry to form a powder;

c. forming the powder into a preform; and d. sintering the preform to form a varistor body.

Figure 1:
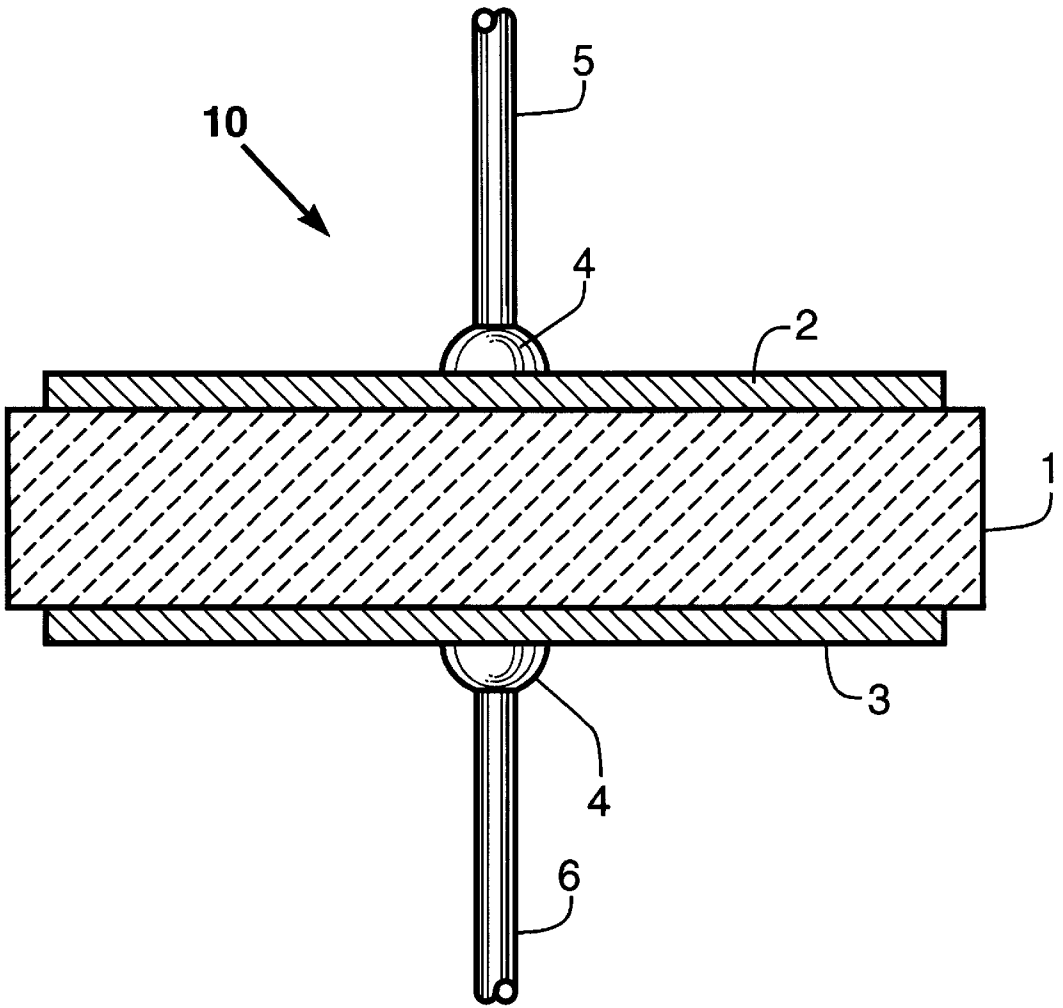
FIG. 1 is a partly cross-sectional view of a varistor which can be made in accordance with an embodiment of the invention.

For a better understanding of the present invention, together with other and further objects, advantages and capabilities thereof, reference is made to the following disclosure and appended claims in connection with the above-described drawings.

DETAILED DESCRIPTION OF THE INVENTION

The preferred method of making a varistor involves the following steps:

Step 1

An essentially homogeneous slurry comprising solid phase constituents, and a conventional liquid spray-drying vehicle is prepared by conventional means. The ratio of solid phase constituents to liquid phase constituents is generally in the range of about 60:40 to about 70:30, the preferable ratio being about 65:35.

Solid phase constituents can be added in elemental or various compound forms in amounts necessary for conversion via sintering to form a target sintered composition. For example, $K_2O$, CaO, MnO, and MgO are usually added to the solid phase initially in the form of their respective carbonates and $Al_2O_3$ is usually added initially in the form of a nitrate. It is particularly advantageous to add these components in water-soluble form in order to facilitate a high degree of homogeneous dispersion thereof in the slurry.

Solid phase constituents of some embodiments of the invention include, in powder form, by wt. %, 0.2–4.0% oxide of at least one rare earth element, preferably $Pr_6O_{11}$, 0–4.0% $Co_3O_4$, 0–0.4% $K_2CO_3$, 0–0.2% $Cr_2O_3$, 0–0.2% $CaCO_3$, 0.0004–0.075% $Al(NO_3)_3.9H_2O$, 0–15% $MnCO_3$, 0–0.1% $MgCO_3$, 0–0.5% $TiO_3$, 0–0.2% $SnO_2$, 0–0.02% $H_3BO_3$, balance ZnO. Rare earth elements are known to include La, Ce, Pr, Nd, Pm, Eu, Gd, Th, Dy, Ho, Er, Tm, Yb, and Lu. Bi is not a constituent of any embodiment of the invention.

The particle sizes of the solid phase constituents should usually be in the range of about 0.6 $\mu$m to about 1.5 $\mu$m. A preferable particle size range is from about 0.9 $\mu$m to about 1 $\mu$m, with a most preferable particle size of about 0.95 $\mu$m.

Suitable liquid vehicle compositions include, but are not limited to those liquid compositions conventionally known and used in the art of spray-drying. An example of a typical liquid vehicle comprises $H_2O$ (preferably deionized), polyvinyl alcohol (PVA), Darvan C, glycerine, and an anti-foam additive.

Step 2

The slurry is spray-dried via a conventional spray-drying apparatus and method to form a powder. The conventional spray-drying apparatus is preferably operated with an inlet temperature in the range of about 250° C. to about 290° C., most preferably about 265° C. Moreover, the conventional spray-drying apparatus is preferably operated with an outlet temperature in the range of about 90° C. to about 105° C., more preferably about 100° C.

The powder formed by the spray-drying process is preferably characterized as agglomerated, non-sticky and freely flowing. A size distribution in the range of about 50 $\mu$m to about 150 $\mu$m is preferably obtained by screening the spray-dried powder to reject particles outside the preselected size distribution range. An optimum size distribution in the range of about 90 $\mu$m to about 110 $\mu$m can also be obtained by screening, but will result in a lower yield.

Moreover, the spray-dried powder is generally characterized by a moisture content in the range of about 0.2% (very dry) to about 0.5% (approaching stickiness), with a preferred range of about 0.3% to about 0.4%.

Step 3

The spray-dried powder is then conventionally formed into a preform of a preselected varistor configuration cold pressing at a pressure in the range of about 10 kpsi to about 20 kpsi, preferably about 15 kpsi. Other forming methods can be used without departing from the scope of the invention.

Step 4

The preform is sintered to form a sintered varistor body as in conventional methods of making varistors. For example, a preform may be sintered at a temperature in the range of about 1100° C. to about 1300° C. for a time in the range of about 1 hour to about 4 hours in air or another oxidizing environment. Suitable sintering schedules may vary widely.

The sintered varistor body is cooled, preferably slowly—at a cooling rate of no more than 10° C./minute, more preferably at no more than 5° C./minute, to ambient.

Electrodes are then applied to the varistor via conventional methods. A commonly used varistor configuration is shown in FIG. 1: A varistor embodiment 10 in accordance with the present invention generally includes, as the active element thereof, a sintered body 1 as described hereinabove. Electrodes 2, 3 are applied to opposite surfaces of the sintered body 1. Wire leads 5, 6 are conductively attached to the electrodes 2, 3 via connection means 4 such as solder or the like.

Varistors made by the method described hereinabove have shown extraordinarily high nonlinearity, very high voltages, and a sharp breakdown characteristic not previously known.

EXAMPLE I

A variety of Bi-free varistors were made in accordance with the present invention using solid phase constituents as described in Table I. A slurry sample was prepared for each sample by mixing respective amounts of solid phase constituents into portions of a conventional liquid spray-drying vehicle. The constituents were mixed until the resulting slurry samples were homogeneous.

Each slurry sample was spray-dried via a conventional spray-drying apparatus and method to form a powder. The spray-drying apparatus was operated with an inlet temperature of 265° C. and an outlet temperature of 100° C. The powder samples formed by the spray-drying process were characterized as agglomerated, non-sticky, freely flowing, and a moisture content of 0.3%. A size distribution in the range of 50 $\mu$m to 150 $\mu$m was obtained by screening the spray-dried powder samples to reject particles outside the preselected size distribution range.

Figure 2:
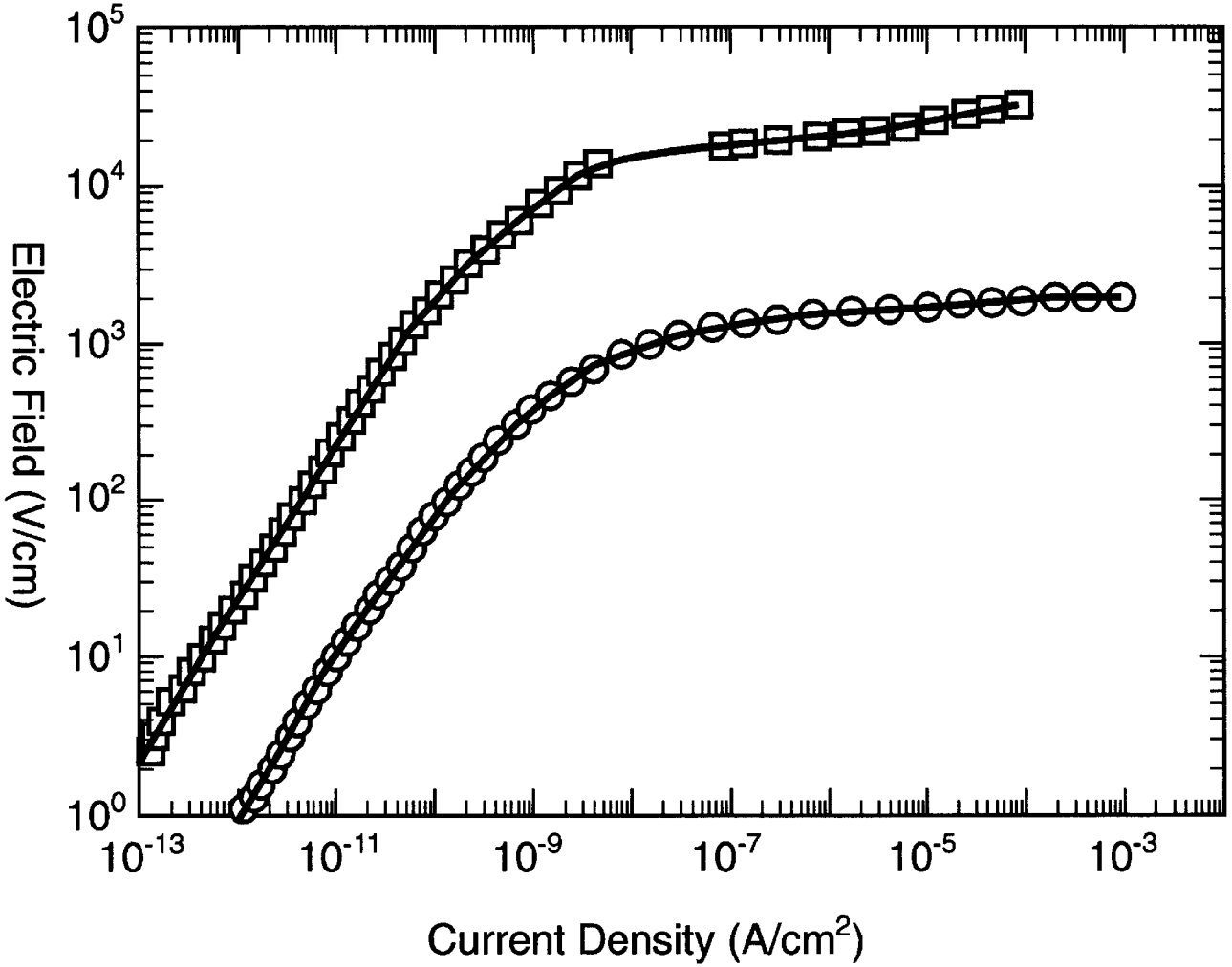
FIG. 2 is a graph showing electric field/current density characteristics of a varistor made in accordance with the present invention compared with a commercially available Bi-doped varistor.
Figure 3:
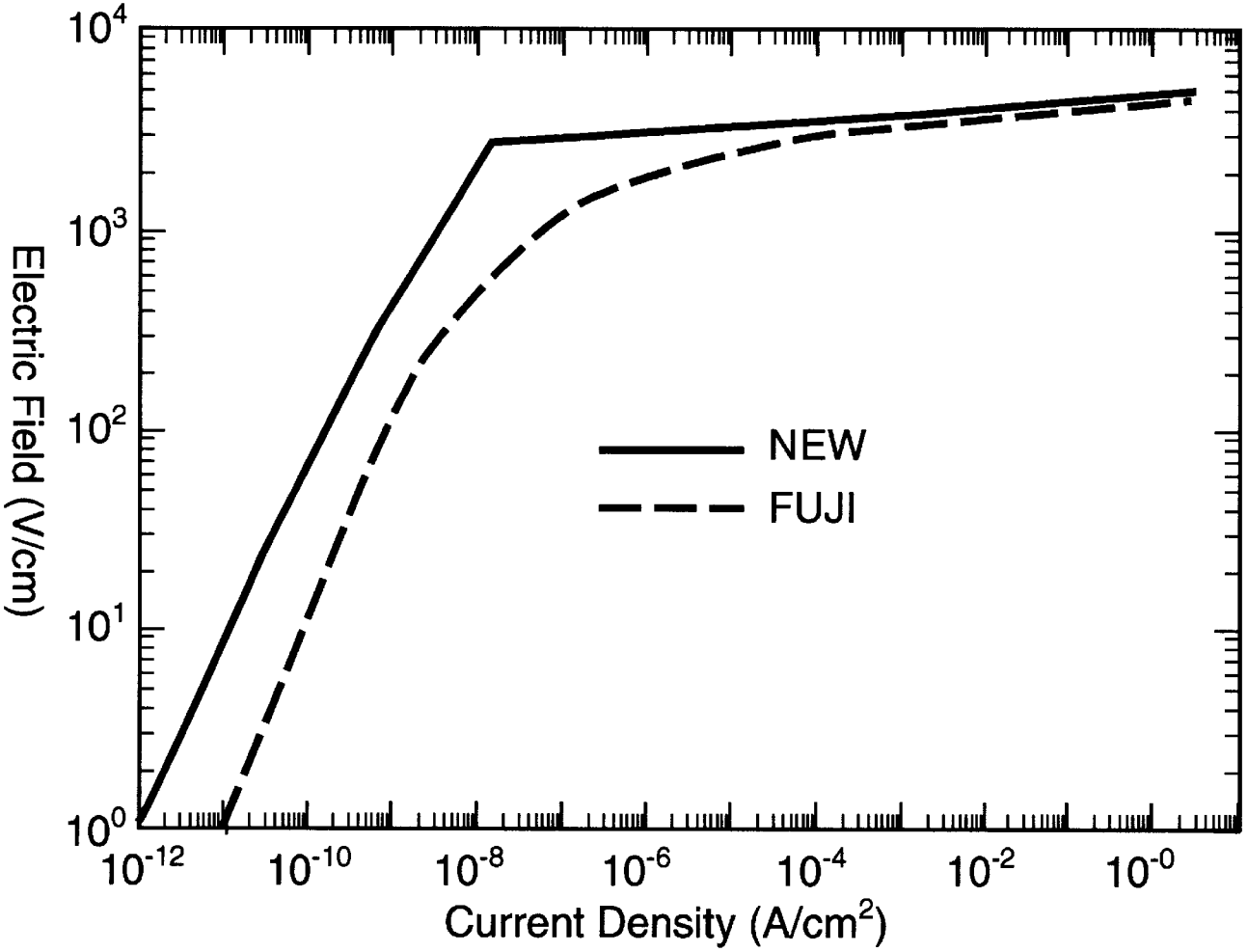
FIG. 3 is a graph showing electric field/current density characteristics of a varistor made in accordance with the present invention compared with another commercially available varistor made by Fuji Electric Company, Ltd., Kanagawa, Japan.
Figure 4:
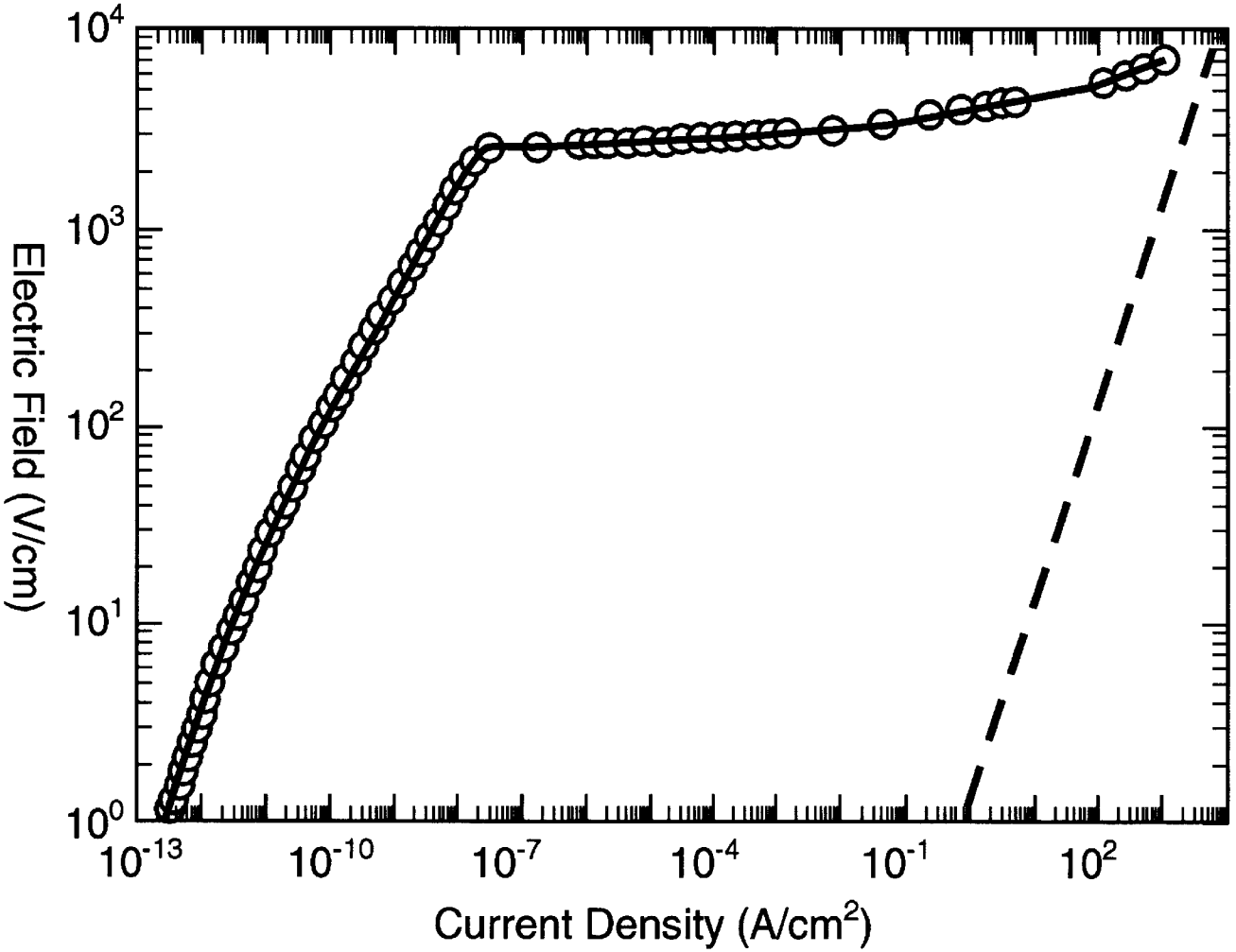
FIG. 4 is a graph showing electric field/current density characteristics of a varistor made in accordance with the present invention compared with the same characteristics of a single grain of the same material.

Each powder sample was conventionally pressed to form a preform and sintered via conventional sintering methods. The sintered varistors comprised the nominal compositions described in Table II. Electrodes were applied to each varistor by conventional, well known methods. Electrical characteristics of the varistor samples were measured. Electrical characteristics of the varistor sample WF5 are shown in FIGS. 2–4.

EXAMPLE II

A varistor was made as in Example I, with a solid phase of the composition of sample WF5: 96.683% ZnO, 1.25% $Pr_6O_{11}$, 1.75% $Co_3O_4$, 0.162% $K_2CO_3$, 0.093% $Cr_2O_3$, 0.061% $CaCO_3$, and 0.001% $Al(NO_3)_3.9H_2O$. The varistor was sintered via the schedule shown in Table III. Electrical characteristics of the varistor thereby produced are shown in FIGS. 2–4. FIG. 4 shows that the varistor exhibited unexpectedly high current field and sharp voltage breakdown characteristics, indicating that the grain boundaries in the bulk material were highly uniform.

TABLE I

| SAMPLE | ZnO | $Pr_6O_{11}$ | $Co_3O_4$ | $K_2CO_3$ | $Cr_2O_3$ | $CaCO_3$ | $Al(NO_3)_3 \cdot 9H_2O$ | $MnCO_3$ | $MgCO_3$ | $TiO_2$ | $SnO_2$ | $H_3BO_3$ |
|---|---|---|---|---|---|---|---|---|---|---|---|---|
| WF1 | 96.684 | 1.040 | 1.960 | 0.162 | 0.093 | 0 | 0.061 | 0 | 0 | 0 | 0 | 0 |
| WF5 | 96.683 | 1.250 | 1.750 | 0.162 | 0.093 | 0.061 | 0.001 | 0 | 0 | 0 | 0 | 0 |
| WF6 | 96.265 | 1.036 | 0.977 | 0.168 | 0.093 | 0.061 | 0 | 1.400 | 0 | 0 | 0 | 0 |
| WF7 | 95.861 | 1.032 | 0 | 0.167 | 0.092 | 0.061 | 0 | 2.787 | 0 | 0 | 0 | 0 |
| WF8 | 96.169 | 1.200 | 1.700 | 0.170 | 0.100 | 0.060 | 0.001 | 0.600 | 0 | 0 | 0 | 0 |
| WF9 | 96.622 | 1.041 | 1.963 | 0.169 | 0.093 | 0.061 | 0 | 0 | 0.051 | 0 | 0 | 0 |
| WF10 | 96.255 | 1.040 | 0.980 | 0.170 | 0.093 | 0.061 | 0.001 | 1.400 | 0 | 0 | 0 | 0 |
| WF11 | 96.215 | 1.100 | 0.900 | 0.180 | 0.093 | 0.061 | 0.001 | 1.450 | 0 | 0 | 0 | 0 |
| WF12 | 96.215 | 1.150 | 0.880 | 0.180 | 0.093 | 0.061 | 0.001 | 1.420 | 0 | 0 | 0 | 0 |
| WF15 | 96.689 | 1.200 | 1.600 | 0.100 | 0.100 | 0.050 | 0.001 | 0 | 0.050 | 0.150 | 0.050 | 0.010 |
| WF16 | 96.689 | 1.150 | 1.500 | 0.120 | 0.100 | 0.060 | 0.001 | 0 | 0.020 | 0.250 | 0.100 | 0.010 |
| WF17 | 96.689 | 1.100 | 1.400 | 0.150 | 0.150 | 0.050 | 0.001 | 0.250 | 0 | 0.100 | 0.100 | 0.010 |
| WF18 | 96.689 | 1.150 | 1.450 | 0.140 | 0.100 | 0.060 | 0.001 | 0 | 0 | 0.400 | 0 | 0.010 |
| WF19 | 96.689 | 1.000 | 1.100 | 0.100 | 0.100 | 0.050 | 0.001 | 0.700 | 0 | 0.200 | 0.050 | 0.010 |
| WF20 | 96.689 | 1.000 | 1.150 | 0.150 | 0.100 | 0.050 | 0.001 | 0.650 | 0 | 0.100 | 0.100 | 0.010 |
| WF21 | 96.689 | 1.000 | 1.000 | 0.160 | 0.150 | 0 | 0.001 | 0.750 | 0 | 0.250 | 0 | 0 |
| WF22 | 96.689 | 0.950 | 1.100 | 0.160 | 0.150 | 0.040 | 0.001 | 0.500 | 0.050 | 0.200 | 0.150 | 0.010 |
| WF23 | 96.689 | 1.000 | 1.000 | 0.100 | 0.100 | 0 | 0.001 | 1.000 | 0 | 0.100 | 0 | 0.010 |

TABLE II

| Sample | ZnO | $Pr_6O_{11}$ | $Co_3O_4$ | $K_2O$ | $Cr_2O_3$ | CaO | $Al_2O_3$ | MnO | MgO | $TiO_2$ | $SnO_2$ | $B_2O_3$ |
|---|---|---|---|---|---|---|---|---|---|---|---|---|
| WF1 | 96.684 | 1.040 | 1.960 | 0.110 | 0.093 | 0 | 0.000829 | 0 | 0 | 0 | 0 | 0 |
| WF5 | 96.683 | 1.250 | 1.750 | 0.110 | 0.093 | 0.034 | 0.00014 | 0 | 0 | 0 | 0 | 0 |
| WF6 | 96.265 | 1.036 | 0.977 | 0.115 | 0.093 | 0.034 | 0 | 0.864 | 0 | 0 | 0 | 0 |
| WF7 | 95.861 | 1.032 | 0 | 0.114 | 0.092 | 0.034 | 0 | 1.720 | 0 | 0 | 0 | 0 |
| WF8 | 96.169 | 1.200 | 1.700 | 0.116 | 0.100 | 0.034 | 0.00014 | 0.370 | 0 | 0 | 0 | 0 |
| WF9 | 96.622 | 1.041 | 1.963 | 0.115 | 0.093 | 0.034 | 0 | 0 | 0.024 | 0 | 0 | 0 |
| WF10 | 96.255 | 1.040 | 0.980 | 0.116 | 0.093 | 0.034 | 0.00014 | 0.864 | 0 | 0 | 0 | 0 |
| WF11 | 96.215 | 1.100 | 0.900 | 0.123 | 0.093 | 0.034 | 0.00014 | 0.895 | 0 | 0 | 0 | 0 |
| WF12 | 96.215 | 1.150 | 0.880 | 0.123 | 0.093 | 0.034 | 0.00014 | 0.876 | 0 | 0 | 0 | 0 |
| WF15 | 96.689 | 1.200 | 1.600 | 0.068 | 0.100 | 0.028 | 0.00014 | 0 | 0.024 | 0.150 | 0.050 | 0.010 |
| WF16 | 96.689 | 1.150 | 1.500 | 0.082 | 0.100 | 0.034 | 0.00014 | 0 | 0.010 | 0.250 | 0.100 | 0.010 |
| WF17 | 96.689 | 1.100 | 1.400 | 0.102 | 0.150 | 0.028 | 0.00014 | 0.154 | 0 | 0.100 | 0.100 | 0.010 |
| WF18 | 96.689 | 1.150 | 1.450 | 0.095 | 0.100 | 0.034 | 0.00014 | 0 | 0 | 0.400 | 0 | 0.010 |
| WF19 | 96.689 | 1.000 | 1.100 | 0.068 | 0.100 | 0.028 | 0.00014 | 0.432 | 0 | 0.200 | 0.050 | 0.010 |
| WF20 | 96.689 | 1.000 | 1.150 | 0.102 | 0.100 | 0.028 | 0.00014 | 0.401 | 0 | 0.100 | 0.100 | 0.010 |
| WF21 | 96.689 | 1.000 | 1.000 | 0.109 | 0.150 | 0 | 0.00014 | 0.463 | 0 | 0.250 | 0 | 0 |
| WF22 | 96.689 | 0.950 | 1.100 | 0.109 | 0.150 | 0.022 | 0.00014 | 0.309 | 0.024 | 0.200 | 0.150 | 0.010 |
| WF23 | 96.689 | 1.000 | 1.000 | 0.068 | 0.100 | 0 | 0.00014 | 0.617 | 0 | 0.100 | 0 | 0.010 |

TABLE III

| Temperature Change (°C.) | Rate (°C./min) | Time (Hours) | Total Time |
|---|---|---|---|
| 25 → 830 | 3 | 4.5 | 4.5 |
| 830 → 1070 | 2 | 2.0 | 6.5 |
| 1070 → 1220 | 1 | 2.5 | 9.0 |
| 1220 → 1220 | 0 | 3.2 | 12.2 |
| 1220 → 1100 | −1 | 2.0 | 14.2 |
| 1100 → 650 | −2 | 3.8 | 18.0 |
| 650 → 25 | −1 | 10.0 | 28.0 |

EXAMPLE III

Varistors were made as in with Example II. Various sintering schedules were used which were similar to that shown in Table I, but with different maximum temperatures. Results are shown in Table IV.

TABLE IV

| Sample | Maximum Sintering Temperature (°) | Time at Maximum (Hours) | Nonlinearity Coefficient | Voltage (kV/cm)* |
|---|---|---|---|---|
| 1 | 1300 | 2 | 25 | 1.2 |
| 2 | 1300 | 2 | 16 | 1.1 |
| 3 | 1140 | 3 | 40 | 6.2 |
| 4 | 1140 | 3 | 55 | 6.7 |
| 5 | 1180 | 3 | 75 | 4.1 |
| 6 | 1140 | 3 | 56 | 7.8 |
| 7 | 1180 | 3 | 54 | 2.7 |
| 8 | 1180 | 3 | 49 | 5.1 |
| 9 | 1180 | 3 | 61 | 4.4 |
| 10 | 1180 | 3 | 52 | 6.0 |
| 11 | 1300 | 4 | 19 | 1.1 |
| 12 | 1300 | 4 | 19 | 1.1 |
| 13 | 1240 | 3.5 | 45 | 2.4 |
| 14 | 1220 | 3.2 | 65 | 2.9 |

*Current density at 1 $mA/cm^2$

Varistors made using the above described compositions via a conventional calcining method produced varistors which had characteristics which were inferior to those made via spray-drying methods as described hereinabove. One disadvantage of calcining is that the calcining furnace generally introduces deleterious contaminants into the varistor composition.

While there has been shown and described what are at present considered the preferred embodiments of the invention, it will be obvious to those skilled in the art that various changes and modifications can be made therein without departing from the scope of the inventions defined by the appended claims.

What is claimed is:

1. A varistor comprising a Bi-free, essentially homogeneous sintered body of a ceramic composition comprising, expressed as nominal weight %, 0.2–4.0% oxide of at least one rare earth element, 0.5–4.0% $Co_3O_4$, 0.05–0.4% $K_2O$, 0.05–0.2% $Cr_2O_3$, 0–0.2% CaO, 0.00005–0.01% $Al_2O_3$, 0–2% MnO, 0–0.05% MgO, 0–0.5% $TiO_3$, 0–0.2% $SnO_2$, 0–0.02% $B_2O_3$, balance ZnO, said sintered body characterized by nonlinear electrical resistance.

2. A varistor in accordance with claim 1 wherein said ceramic composition further comprises, in nominal wt. %: 96.683% ZnO, 1.25% oxide of at least one rare earth element, 1.75% $Co_3O_4$, 0.162% $K_2O$, 0.093% $Cr_2O_3$, 0.061% CaO, and 0.001% $Al_2O_3$.

3. A varistor in accordance with claim 1 wherein said rare earth element comprises $Pr_6O_{11}$.

4. A method of making a varistor comprising the steps of:

a. preparing an essentially homogeneous slurry comprising a liquid spray-drying vehicle and a Bi-free mixture of appropriate solid constituents comprising: 0.2–4.0% $Pr_6O_{11}$, 0–4.0% $Co_3O_4$, 0–0.4% $K_2CO_3$, 0–0.2% $Cr_2O_3$, 0–0.2% $CaCO_3$, 0.0004–0.075% $Al(NO_3)_3 \cdot 9H_2O$, 0–15% $MnCO_3$, 0–0.1% $MgCO_3$, 0–0.5% $TiO_2$, 0–0.2% $SnO_2$, 0–0.02% $H_3BO_3$, balance ZnO;

b. spray-drying said slurry to form a powder;

c. forming said powder into a preform; and d. sintering said preform to form a varistor body.

5. A method in accordance with claim 1 wherein said powder is characterized as freely flowing.

6. A method in accordance with claim 1 wherein said powder is characterized as agglomerated.

7. A method of making a varistor comprising the steps of:

a. preparing an essentially homogeneous slurry comprising a liquid spray-drying vehicle and a Bi-free mixture of appropriate constituents comprising preselected relative amounts of Zn, at least one rare earth element, Co, K, Cr, Ca, Al, Mn, Mg, Ti, Sn, and B;

b. spray-drying said slurry to form a powder;

c. forming said powder into a preform; and d. sintering said preform to form a varistor body comprising expressed as nominal weight %, 0.2–4.0% oxide of at least one rare earth element, 0.5–4.0% $Co_3O_4$, 0.05–0.4% $K_2O$, 0.05–0.2% $Cr_2O_3$, 0–0.2% CaO, 0.00005–0.01% $Al_2O_3$, 0–2% MnO, 0–0.05% MgO, 0–0.5% $TiO_3$, 0–0.2% $SnO_2$, 0–0.02% $B_2O_3$, balance ZnO.

* * * * *